US008196749B2

(12) United States Patent
Chatelain

(10) Patent No.: US 8,196,749 B2
(45) Date of Patent: Jun. 12, 2012

(54) SLIDE AND SHELL CONTAINER WITH HINGED FLAP

(75) Inventor: Lucas Chatelain, Savigny (CH)

(73) Assignee: Philip Morris USA Inc., Richmond, VA (US)

( * ) Notice: Subject to any disclaimer, the term of this patent is extended or adjusted under 35 U.S.C. 154(b) by 250 days.

(21) Appl. No.: 12/635,862

(22) Filed: Dec. 11, 2009

(65) Prior Publication Data

US 2010/0155273 A1 Jun. 24, 2010

(30) Foreign Application Priority Data

Dec. 11, 2008 (EP) ..... 08253965

(51) Int. Cl.
*B65D 25/00* (2006.01)

(52) U.S. Cl. ..... 206/767; 206/270

(58) Field of Classification Search ..... 206/265, 206/270, 271, 273, 766, 767, 45.28, 768, 206/459.5

See application file for complete search history.

(56) References Cited

U.S. PATENT DOCUMENTS

| | | | | |
|---|---|---|---|---|
| 149,889 | A | | 4/1874 | Smith |
| 727,600 | A | | 5/1903 | Doscher |
| 1,185,560 | A | | 5/1916 | Walcutt |
| 1,459,439 | A | | 6/1923 | Burton |
| 1,562,497 | A | | 11/1925 | Roberts |
| 1,608,229 | A | | 11/1926 | Twomley |
| 2,163,828 | A | | 6/1939 | Walker |
| 2,213,525 | A | | 9/1940 | LaFlamme |
| 2,597,810 | A | | 5/1952 | Myers |
| 2,799,441 | A | * | 7/1957 | Nerney ..... 229/122.34 |
| 2,872,097 | A | | 2/1959 | Graybill |
| 2,929,542 | A | | 3/1960 | O'Gorman |
| 2,990,994 | A | | 7/1961 | Hackmyer |
| 3,311,283 | A | | 3/1967 | Katsuji et al. |
| 3,327,888 | A | | 6/1967 | Chalmers et al. |
| 3,400,874 | A | | 9/1968 | Shimada et al. |
| 3,416,719 | A | | 12/1968 | Pilger |

(Continued)

FOREIGN PATENT DOCUMENTS

DE 570 351 2/1933

(Continued)

OTHER PUBLICATIONS

International Preliminary Report on Patentability issued Jun. 14, 2011 for International Application No. PCT/EP2009/008831.

(Continued)

*Primary Examiner* — Jacob K Ackun

(74) *Attorney, Agent, or Firm* — Buchanan Ingersoll & Rooney PC

(57) ABSTRACT

A slide and shell container includes an outer shell having a first wall with an aperture provided therein; an inner slide slidable within the outer shell between a closed position in which the interior of the inner slide is inaccessible and an open position in which the interior of the inner slide is accessible; and a hinged flap connected to the inner slide that protrudes through the aperture in the first wall of the outer shell. The hinged flap is pivotable between a first position in which the flap rests against the first wall of the outer shell and a second position in which the flap is hinged outwardly from the first wall of the outer shell upon slidable movement of the inner slide between the closed position and the open position.

10 Claims, 3 Drawing Sheets

U.S. PATENT DOCUMENTS

| | | | | |
|---|---|---|---|---|
| 3,858,788 | A | 1/1975 | Phillips, Jr. | |
| 3,899,125 | A | 8/1975 | Andrews et al. | |
| 3,933,299 | A | 1/1976 | Shimada et al. | |
| 3,977,520 | A | 8/1976 | Grimm | |
| 4,049,117 | A | 9/1977 | Grimm | |
| 4,267,926 | A | 5/1981 | Toimil | |
| 4,646,960 | A * | 3/1987 | Challand | 206/259 |
| 4,714,082 | A | 12/1987 | Banerjee et al. | |
| 4,729,508 | A | 3/1988 | Erdmann et al. | |
| 4,779,723 | A | 10/1988 | Focke et al. | |
| 4,923,059 | A | 5/1990 | Evers et al. | |
| 5,692,525 | A | 12/1997 | Counts et al. | |
| 5,799,781 | A * | 9/1998 | Arthur | 206/246 |
| 6,044,973 | A | 4/2000 | Vasudeva | |
| 6,162,516 | A | 12/2000 | Derr | |
| 6,474,468 | B1 * | 11/2002 | Griffith | 206/267 |
| 6,527,166 | B1 | 3/2003 | Focke et al. | |
| 6,591,982 | B2 | 7/2003 | Focke et al. | |
| 7,273,145 | B2 | 9/2007 | Focke et al. | |
| 7,431,153 | B2 * | 10/2008 | Li Vigni et al. | 206/271 |
| 7,604,117 | B2 | 10/2009 | Bourgoin et al. | |
| 2002/0000389 | A1 | 1/2002 | Garcia | |
| 2002/0020640 | A1 * | 2/2002 | Garcia | 206/246 |
| 2004/0026271 | A1 | 2/2004 | Conti et al. | |
| 2004/0026272 | A1 | 2/2004 | Conti et al. | |
| 2005/0029131 | A1 | 2/2005 | Draghetti et al. | |
| 2005/0103654 | A1 | 5/2005 | Hennessy | |
| 2006/0278542 | A1 | 12/2006 | Pham et al. | |
| 2008/0121538 | A1 | 5/2008 | Buse | |
| 2008/0128301 | A1 | 6/2008 | Bourgoin et al. | |
| 2008/0142578 | A1 | 6/2008 | Vickerstaff | |
| 2009/0008277 | A1 | 1/2009 | Agirbas | |
| 2009/0065561 | A1 | 3/2009 | Bourgoin et al. | |
| 2009/0184158 | A1 | 7/2009 | Lutzig et al. | |
| 2010/0032324 | A1 | 2/2010 | Lutzig et al. | |
| 2010/0065449 | A1 | 3/2010 | Morgan et al. | |
| 2010/0176011 | A1 | 7/2010 | Chatelain | |

FOREIGN PATENT DOCUMENTS

| | | | |
|---|---|---|---|
| DE | 1054373 | B | 4/1959 |
| DE | 7525528 | U | 12/1975 |
| DE | 7826336 | U1 | 12/1978 |
| DE | 90 11 464 | | 1/1991 |
| DE | 202005011562 | U1 | 9/2005 |
| EP | 1927549 | A1 | 11/2006 |
| EP | 1847478 | A1 | 10/2007 |
| FR | 1037831 | A | 9/1953 |
| FR | 2495114 | A | 6/1982 |
| GB | 395 501 | | 7/1933 |
| GB | 468409 | | 7/1937 |
| GB | 532 784 | | 1/1941 |
| GB | 1042445 | | 9/1966 |
| GB | 1075618 | A | 7/1967 |
| GB | 2 309 021 | A | 7/1997 |
| GB | 2 396 854 | A | 7/2004 |
| JP | 2000-85749 | | 3/2000 |
| WO | WO 03/024839 | A | 3/2003 |
| WO | WO 03/091130 | | 11/2003 |
| WO | WO 2005/016036 | A1 | 2/2005 |
| WO | WO 2007/028481 | A1 | 3/2007 |
| WO | WO 2007/060395 | A1 | 5/2007 |
| WO | WO 2008/065038 | | 6/2008 |

OTHER PUBLICATIONS

International Search Report dated Feb. 3, 2010 for European Patent Application No. 09252010.5-2308.

U.S. Appl. No. 12/858,874 to Chatelain et al., filed Aug. 18, 2010.

International Search Report and Written Opinion mailed Apr. 1, 2009 for PCT/EP2009/000318.

Search Report from European Patent Application No. EP07115236.

International Search Report and Written Opinion mailed May 11, 2009 for PCT/IB2008/003014.

International Search Report dated Jun. 4, 2008 for European Patent Application No. 08253880.2-1261.

International Search Report and Written Opinion mailed Apr. 8, 2010 for PCT/EP2009/009215.

International Preliminary Report on Patentability issued Mar. 2, 2010 for PCT/IB2008/003014.

European Search Report dated May 2, 2007, issued in European Patent Application No. EP 06 25 6126.

International Search Report for European Application No. 06125140.1-2308 dated May 2, 2007.

International Search Report and Written Opinion mailed Apr. 21, 2010 for PCT/EP2009/008831.

* cited by examiner (a)

SLIDE AND SHELL CONTAINER WITH HINGED FLAP

CROSS REFERENCE TO RELATED APPLICATION

This application claims priority to European Application No. 08253965.1, filed Dec. 11, 2008, the entire content of which is incorporated herein by this reference thereto.

BACKGROUND

The present invention relates to a slide and shell container with a hinged flap, which finds particular application as a container for smoking articles such as cigarettes.

It is known to package smoking articles and other consumer goods in containers including an outer shell and an inner slide or tray in which the consumer goods are housed and which is slidable within the outer shell. To remove consumer goods from such containers, a consumer slides the inner slide from an initial position within the outer shell to an open position in which the inner slide projects outwardly from the outer shell. Slide and shell containers in which the consumer goods are housed in an inner slide having a hinged lid that covers an open end of the inner slide are also known.

Graphics and text are typically applied to the exterior of packaging for consumer goods in order to communicate information to the consumer. However, packs of smoking articles are typically relatively small in size, and so have limited visible exterior surface area for displaying such information. It is known to include additional panels on packs of smoking articles in order to increase the surface area available for displaying graphics and text and hence the amount of information that may be communicated to a consumer.

It would be desirable to provide slide and shell containers for consumer goods, in particular smoking articles, having substantially the same external appearance as known slide and shell containers, but with additional surface areas that may carry, for example, supplementary brand, advertising, promotional or product information.

SUMMARY OF SELECTED ASPECTS OF THE INVENTION

A slide and shell container includes an outer shell having a first wall with an aperture provided therein, an inner slide slidable within the outer shell between a closed position in which the interior of the inner slide is inaccessible and an open position in which the interior of the inner slide is accessible, and a hinged flap connected to the inner slide and protruding through the aperture in the first wall of the outer shell. The hinged flap is pivotable between a first position in which the flap rests against the first wall of the outer shell and a second position in which the flap is hinged outwardly from the first wall of the outer shell upon slidable movement of the inner slide between the closed and open positions. Preferably, the inner slide includes a box portion and a lid portion connected to the box portion along a hinge about which the lid portion is pivotable when the inner slide is in the open position. Also preferably, the hinged flap is connected to the box portion of the inner slide and the hinge flap is of substantially the same dimensions as the first wall of the outer shell. The hinge flap may partially cover the outer surface of the first wall of the outer shell in the first position, and may be integral with the inner slide. The hinged flap can includes two or more integral, foldably connected, overlying sub-panels.

The container can also include retention means for preventing removal of the inner slide from the outer shell and a pull tab connected to the inner slide, which, in use, may be grasped and pulled on by a consumer in order to slide the inner slide within the outer shell from the closed position to the open position. In the preferred embodiment, the inner slide houses a plurality of smoking articles.

BRIEF DESCRIPTION OF THE DRAWINGS

The invention will be further described, by way of example only, with reference to the accompanying drawings in which.

DETAILED DESCRIPTION

Figure 1:
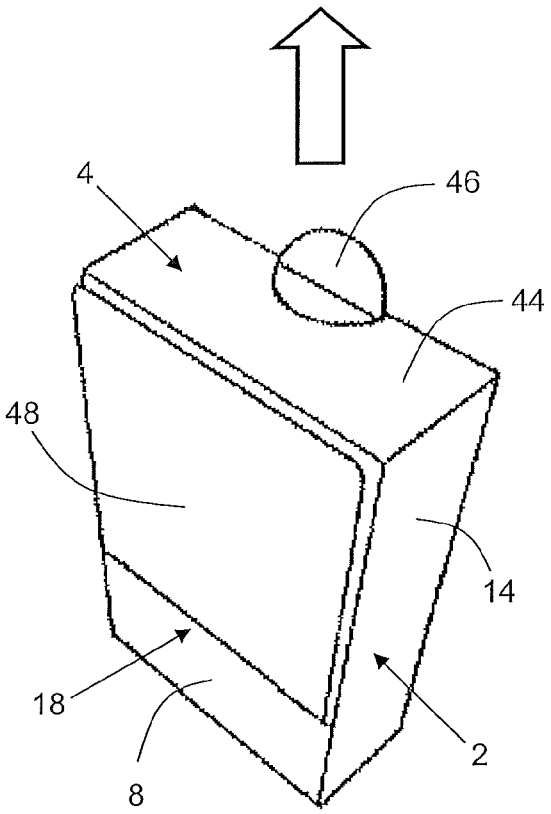
FIG. 1 shows a perspective view of a slide and shell container according to an embodiment of the invention with the inner slide in a closed position.

A slide and shell container includes an outer shell having a first wall with an aperture provided therein; an inner slide slidable within the outer shell between a closed position in which the interior of the inner slide is inaccessible and an open position in which the interior of the inner slide is accessible; and a hinged flap connected to the inner slide. The hinged flap protrudes through the aperture in the first wall of the outer shell. The hinged flap is pivotable from a first position in which the flap rests against the first wall of the outer shell to a second position in which the flap is hinged outwardly from the first wall of the outer shell. This is caused by slidable movement of the inner slide from the closed position to the open position.

The hinged flap rests against the first wall of the outer shell in the first position. However, when a consumer slides the inner slide from the closed position to the open position, in order to access consumer goods housed in the inner slide, the flap is automatically pivoted from the first position to the second position in which it is hinged outwardly from a first wall of the outer shell. This exposes the inner surface of the flap and also the outer surface of the first wall of the outer shell that is covered by the flap when the flap is in the first position. Consequently the inner surface of the flap and the outer surface of the first wall of the outer shell covered by the flap when the flap is in the first position become visible to the consumer when the container is opened.

The inclusion of a flap in containers according to the invention thereby advantageously increases the surface area available for displaying consumer information compared to known slide and shell containers, since graphics and text may be applied to both the outer surface of the first wall of the outer shell, the inner and outer surfaces of the flap, and the outer surface of the inner slide.

In the open position, at least a portion of the inner slide projects outwardly from the outer shell through an open face thereof such that the interior of the inner slide is accessible. The outer shell may have a single open face. Alternatively, the outer shell may be an open-ended sleeve with a pair of opposed open faces.

Preferably, the inner slide is slidable within the outer shell in a direction parallel to a longitudinal axis of the slide and shell container. For example, the inner slide may be slidable lengthways within the outer shell so that a portion of the inner slide projects outwardly from the outer shell through an open end face thereof in the open position. Alternatively, the inner slide may be slidable within the outer shell in a direction parallel to a transverse axis of the slide and shell container. For example, the inner slide may be slidable laterally within the outer shell so that a portion of the inner slide projects outwardly from the outer shell through an open side face thereof in the open position.

The first wall of the outer shell is in a plane parallel to the direction of movement of the inner slide within the outer shell. Preferably, the first wall is a major wall of the outer shell.

Preferably, the aperture provided in the first wall of the outer shell is an elongate aperture. For example, where the inner slide is slidable within the outer shell in a direction parallel to a longitudinal axis of the slide and shell container, the aperture is preferably an elongate aperture with a longitudinal axis substantially parallel to a transverse axis of the slide and shell container. In a particularly preferred embodiment of the invention, the aperture is a transverse slit.

Through an appropriate choice of the location of the aperture therein, the outer surface of the first wall of the outer shell may be substantially fully covered or only partially covered by the flap in the first position. Preferably, the outer surface of the first wall of the outer shell is only partially covered by the flap in the first position.

Preferably, the flap is integral with the inner slide. More preferably, the flap and inner slide are formed from a single one-piece laminar blank. However, the flap may alternatively be non-integral with the inner slide and connected thereto during production of the container. For example, the flap and inner slide may be formed from two separate laminar blanks and the flap adhered or otherwise affixed to the inner slide during production of the container.

Where the flap and inner slide are formed from a single one-piece laminar blank, the flap is preferably formed from two panels affixed to one another in an overlying registered relationship. As described in more detail below, this advantageously enables the inner and outer surfaces of the flap to be printed on only one side of the blank, as opposed to printing both sides of the blank.

The flap is connected to the inner slide along a hinge line substantially perpendicular to the direction of slidable movement of the inner slide within the outer shell. The flap may be directly connected to the inner slide along the hinge line. Alternatively, the flap may be indirectly connected to the inner slide along the hinge line via one or more intervening panels. In use, slidable movement of the inner slide within the outer shell between the closed and open positions moves the hinge line relative to the aperture in the first wall of the outer shell causing the flap to pivot about the hinge line between the first and second positions.

Preferably, slidable movement of the inner slide within the outer shell between the closed and open positions moves the hinge line between positions on either side of the aperture in the first wall of the outer shell.

For example, the hinge line about which the hinged flap is pivotable may be moved between a position below the aperture and a position above the aperture by vertically sliding the inner slide between the closed and open positions. Alternatively, the hinge line about which the hinged flap is pivotable may be moved between a position to the left of the aperture and a position to the right of the aperture by horizontally sliding the inner slide between the closed and open positions.

In one embodiment, the flap is connected to a wall of the inner slide parallel and adjacent to the first wall of the outer shell. In an alternative embodiment, the flap is connected to a wall of the inner slide parallel and distant to the first wall of the outer shell. Preferably, the flap is connected to a major wall of the inner slide.

The flap may be of any suitable shape. For example, the flap may have or reflect the shape of the consumer goods intended to be housed in the inner slide or a logo or trade mark associated with the brand or manufacturer of the consumer goods, provided it does not hinder slidable movement of the inner slide.

The dimensions of the flap are preferably such that in the first position the flap does not extend beyond the edges of the first wall of the outer shell, and so does not substantially affect the overall size and shape of the container when the inner slide is in the closed position. This means that containers may be stored or displayed in conventional point of sale fixtures and sold using typical vending machines for slide and shell containers. Another advantage is that it allows existing processes and machinery for typical slide and shell containers to be used for any subsequent processing of containers according to the invention such as, for example, overwrapping, labelling and shipping.

To maximize the additional surface area available for displaying consumer information, the flap may be of substantially the same dimensions as the first wall of the outer shell. Alternatively, the flap may be of reduced dimensions compared to the first wall of the outer shell.

Containers may advantageously include a pull tab connected to the inner slide, which, in use, may be grasped and pulled on by a consumer in order to slide the inner slide from the closed position to the open position. Preferably, the inner slide includes an integral pull tab. More preferably, the inner slide includes an integral pull tab formed in or from a portion of a wall of the inner slide that is accessible through an open face of the outer shell in the closed position.

Instead of or in addition to, the provision of a pull tab, at least one cut-out or notch may be advantageously provided along a free edge of an open face of the outer shell. For example, a pair of opposed cut-outs or notches may be provided along opposed free edges of an open face of the outer shell. In use, a consumer may grasp the inner slide through the one or more cut-outs in order to slide the inner slide from the closed position to the open position. Alternatively, or in addition, an opening may be provided in a wall of the outer shell opposed to an open face thereof in order to facilitate movement of the inner slide from the closed position to the open position by the consumer. In use, a consumer may push the inner slide through the opening provided in the wall of the outer shell in order to slide the inner slide from the closed position to the open position. In the open position, at least a portion of the inner slide projects outwardly from the outer shell through the opposed open face.

In yet a further embodiment, the outer shell may be a sleeve with a pair of opposed open faces. A consumer may push the inner slide through one of the open faces in order to slide the inner slide from the closed position to an open position. In the open position, at least a portion of the inner slide projects outwardly from the outer sleeve through the other opposed open face.

The inner slide may be of any suitable construction that enables consumer goods housed within the inner slide to be removed from the container when the inner slide is in the open position. For example, the inner slide may be a tray or box with an open face or other access opening that is covered by a wall of the outer shell in the closed position, but which is at least partially exposed when the inner slide is in the open position.

Alternatively, or in addition, the inner slide may include a box portion and a lid portion connected to the box portion along a hinge line that extends across a wall of the inner slide. In use, when the inner slide is in the open position, the lid portion of the inner slide may be pivoted about the hinge line in order to gain or facilitate access to consumer goods housed in the inner slide. Where the inner slide includes a box portion and a lid portion, the hinged flap is preferably connected to the box portion of the inner slide.

The hinged flap may be connected to a wall of the inner slide that does not contain the hinge line. Alternatively, the hinged flap may be connected to the wall of the inner slide across which the hinge line extends.

In such embodiments, the container may further include a lid opening mechanism that automatically pivots the lid portion about the hinge line. This is caused by slidable movement of the inner slide within the outer shell from the closed position to the open position. Suitable lid-opening mechanisms are known in the art and described in, for example, EP-A-1 847 478 and EP-A-1 927 549. The lid opening mechanism may, for example, include a hook or flap connected to the lid portion of the inner slide and a flap or abutment edge projecting inwardly from a wall of the outer shell. These components of the lid opening mechanism engage one another upon slidable movement of the inner slide within the outer shell from the closed position to the open position causing the lid to open.

The hinge line along which the box portion and lid portion of the inner slide are connected preferably extends across a wall of the inner slide distant from the first wall of the outer shell. This is preferred in embodiments where the container includes a lid-opening mechanism, so that, in use, operation of the lid-opening mechanism does not interfere with pivotal movement of the hinged flap between the first and second positions.

To increase the additional surface areas on which brand, advertising, promotional, product and other consumer information may be provided, the hinged flap may include two or more integral, foldably connected, overlying sub-panels that, in use, may be unfolded by a consumer to expose consumer information provided on the surfaces thereof. The integral, foldably connected, sub-panels are preferably retained in the overlying position by, for example, re-sealable adhesive. For example, the flap may include two integral, book-folded, overlying sub-panels, or three or more integral, accordion or zig-zag folded, overlying sub-panels.

Alternatively, or in addition, to increase the additional surface areas provided, containers may include an outer shell having two or more walls with apertures provided therein and two or more flaps connected to the inner slide thereof. Each of the flaps protrudes through a separate one of the apertures. The flaps are all pivotable between a first position and a second position upon slidable movement of the inner slide between the closed and open positions. For example, containers may include a first flap connected to a first wall of the inner slide that protrudes through an aperture provided in a front wall of the outer shell, and a second flap connected to a second wall of the inner slide that protrudes through an aperture provided in a rear wall of the outer shell.

Preferably, the slide and shell container further includes retention means for preventing removal of the inner slide from the outer shell. For example, the container may include one or more flaps, tabs or other mechanical retention means for preventing removal of the inner slide from the outer shell. Preferably, the retention means restricts or substantially prevents slidable movement of the inner slide beyond the open position. The retention means may include a first retention means on the outer shell and a second retention means on the inner slide that in use cooperate to prevent slidable movement of the inner slide beyond the open position. For example, the retention means may include at least one hinged flap on the outer shell and at least one hinged flap or fixed projection on the inner slide that in use cooperate to prevent slidable movement of the inner slide beyond the open position.

In the closed position, the interior of the inner slide is inaccessible and consumer goods housed in the inner slide cannot be removed from the container. In the open position, the interior of the inner slide is accessible and consumer goods housed in the inner slide may be removed from the container. The closed position and the open position are opposite extremes of a range of slidable movement of the inner slide within the outer shell. It will be appreciated that the inner slide is slidable within the outer shell from the closed position to intermediate 'partially open' positions located between the closed position and the open position. Containers may be used as packages for a variety of consumer goods. In a particularly preferred embodiment, containers are used to package smoking articles. Slide and shell containers may be advantageously used to package smoking articles including, but not limited to, conventional lit-end cigarettes, cigars or cigarillos, heated smoking articles including a combustible fuel element or heat source and an aerosol-generating substrate (for example cigarettes of the type disclosed in U.S. Pat. No. 4,714,082) and smoking articles for use with electrical smoking systems (for example cigarettes of the type disclosed in U.S. Pat. No. 5,692,525).

It will be appreciated that through an appropriate choice of the dimensions thereof, the inner slide of containers may house different total numbers of smoking articles or different arrangements of smoking articles. For example, the inner slide may house a total of between ten and thirty smoking articles.

The smoking articles may be arranged in different collations, depending on the total number of smoking articles. For example, the smoking articles may be arranged in a single row of six, seven, eight, nine or ten. Alternatively, the smoking articles may be arranged in two or more rows. The two or more rows may contain the same number of smoking articles. For example, the smoking articles may be arranged in: two rows of five, six, seven, eight, nine or ten; three rows of five or seven; or four rows of four, five or six. Alternatively, the two or more rows may include at least two rows containing different numbers of smoking articles to each other. For example, the smoking articles may be arranged in: a row of five and a row of six (5-6); a row of six and a row of seven (6-7); a row of seven and a row of eight (7-8); a middle row of five and two outer rows of six (6-5-6); a middle row of five and two outer rows of seven (7-5-7); a middle row of six and two outer rows of five (5-6-5); a middle row of six and two outer rows of seven (7-6-7); a middle row of seven and two outer rows of six (6-7-6); a middle row of nine and two outer rows of eight (8-9-8); or a middle row of six with one outer row of five and one outer row of seven (5-6-7).

Alternatively or in addition, the inner slide may house smoking articles of different dimensions (for example, smoking articles of different length or different circumference). For example, the inner slide may house smoking articles with lengths of between about 40 mm and about 180 mm and diameters of between about 4 mm and about 9 mm.

The inner slide may house filterless smoking articles and smoking articles with various filter tips. In addition, the inner slide may house smoking articles of the same type or brand, or of different types or brands (for example, smoking articles with different filters, tobacco blends, flavors, total particulate matter delivery, resistance to draw or nicotine delivery). Preferably, the dimensions of the inner slide are adapted to the length of smoking articles, and the collation of the smoking articles housed therein. Typically, the outer dimensions of the inner slide are between about 0.5 mm and about 5 mm larger than the dimensions of the bundle or bundles of smoking articles housed therein.

Where the inner slide of a container houses a plurality of cigarettes or other smoking articles, the smoking articles are preferably wrapped in an inner liner of, for example, metal foil or metallised paper.

The outer shell, inner slide and flap of containers may be formed from any suitable material including, but not limited to, cardboard, paperboard, plastic, metal or combinations thereof. The outer shell and inner slide may be formed from the same or different materials.

The flap may be formed from the same or different materials to the outer shell and, where the flap is not integral with the inner slide, from the same or different materials to the inner slide. Preferably, the outer shell, inner slide and flap are formed from folded laminar blanks, more preferably from folded laminar cardboard blanks. Preferably, the cardboard has a weight of between about 100 grams per square meter and about 350 grams per square meter. Preferably, the outer sleeve and the inner slide are each formed from a single one-piece folded laminar blank. More preferably, the outer sleeve is formed from a first single one-piece folded laminar blank and the inner slide and flap are formed from a second single one-piece folded laminar blank.

Containers may be overwrapped in a known manner with any suitable known material or combination of materials including, but not limited to, cellophane, polymeric films of, for example, polyethylene or polypropylene, metallised polymeric films and laminated polymeric films. Containers may be overwrapped with overwrappers including one or more tear tapes. The one or more tear tapes may extend in a transverse or longitudinal direction around the perimeter of the container.

The inner and outer surfaces of the outer shell, inner slide and flap may be printed, embossed, debossed or otherwise embellished (for example, using labels or stickers) with manufacturer or brand logos, trade marks, slogans and other consumer information and indicia.

Preferably, the internal dimensions of the outer shell are substantially the same as the external dimensions of the inner slide, so that inner surfaces of the outer shell overlie and abut outer surfaces of the inner slide in the closed position. In use, frictional forces generated between the outer surfaces of the inner slide and the abutting inner surfaces of the outer shell resist slidable movement of the inner slide between the closed position and the open position. This advantageously prevents opening and closing of the container without the application of a positive force by the consumer.

The outer shell and inner slide of may be substantially rectangular parallepipeds, with right-angled longitudinal and right-angled transverse edges. Alternatively, the outer shell and inner slide may include one or more generally rounded longitudinal edges, generally rounded transverse edges, generally bevelled longitudinal edges, generally bevelled transverse edges or combinations thereof. For example, by scoring in a known manner laminar blanks from which the outer shell and the inner slide of the container are erected, a "rounded-corner" multi-compartment slide and shell container may be produced.

Figure 2:
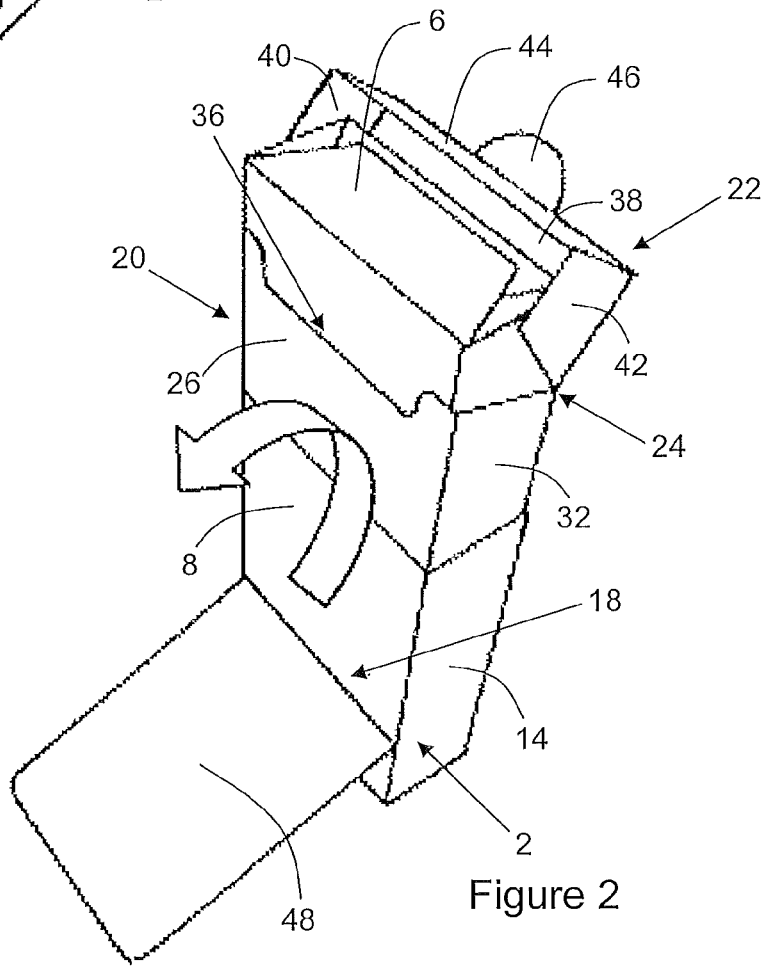
FIG. 2 shows a perspective view of the container of FIG. 1 with the inner slide in an open position.

The slide and shell container shown in FIG. 1 and FIG. 2 is a rectangular parallelepiped and includes an outer shell 2 and an inner slide 4 slidable within the outer shell 2, which houses a wrapped bundle of cigarettes 6. In the following description of the container the terms "upper" and "top", "bottom" and "lower" and "front" and "rear", are used to describe the relative positions of components of the outer shell 2 and inner slide 4 when the container is held in an upright position by a consumer so that the inner slide 4 is slidable in a substantially vertical direction within the outer shell 2 between the closed and open positions. These terms are used irrespective of the actual orientation of the container shown in the Figures.

Figure 3:
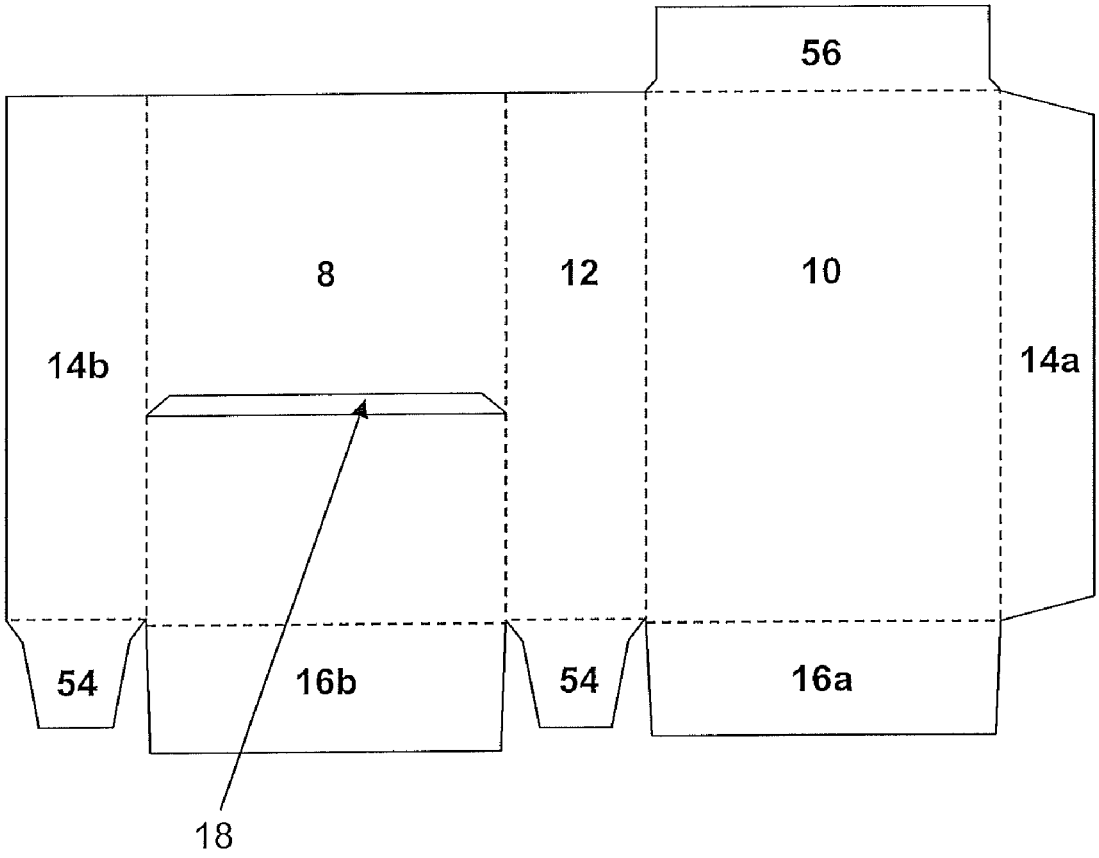
FIG. 3 shows a plan view of a laminar cardboard blank for forming the outer shell of the container of FIG. 1 and FIG. 2.

The outer shell 2 has a front wall 8 and an opposed rear wall 10 (shown in FIG. 3), a left side wall 12 (shown in FIG. 3) and an opposed right side wall 14 and a bottom wall 16 (shown in FIG. 3). As shown in FIG. 1 and FIG. 2, the front wall 8 and the rear wall 10 are major walls of the outer shell 2. The walls 8, 10, 12, 14, 16 of the outer shell 2 define a cup-shaped receptacle with an open upper rectangular end face defined by the upper transverse edges of the front wall 8, rear wall 10, left side wall 12 and right side wall 14, within which the inner slide 4 is inserted. A slit 18 provided in the front wall 8 of the outer shell 2 proximate the bottom wall 16 thereof extends transversely between the left 12 and right 14 side walls of the outer shell 2.

The inner slide 4 of the container shown in FIG. 1 and FIG. 2 has a lower box portion 20 and an upper lid portion 22, which is hinged to the lower box portion 20 along a transverse hinge line 24 that extends across the rear of the inner slide 4. The lower box portion 20 has a front wall 26 and an opposed rear wall 28, a left side wall 30 and an opposed right side wall 32 and a bottom wall 34. As shown in FIG. 2, a central cut-out 36 is provided along the free transverse upper edge of the front wall 26 of the box portion 20 of the inner slide 4.

The upper lid portion 22 has a rear wall 38, a left side wall 40 and an opposed right side wall 42, which function as continuations of the corresponding walls of the lower box portion 20 when the lid portion 22 is in a closed position. The upper lid portion 22 also has a top wall 44, which opposes the bottom wall 34 of the lower box portion 20 when the lid portion 22 is in the closed position. The lid portion 22 has a rectangular open front face defined by the free longitudinal front edges of the left 40 and 42 right side walls and transverse front edge of the top wall 44 of the lid portion 22 and the upper free edge of the front wall of the box portion 20 of the inner slide 4. As shown in FIG. 1 and FIG. 2, a generally semi-circular pull tab 46, which is cut out from the upper wall 44 of the lid portion 22 of the inner slide 4 extends upwardly from the rear wall 38 thereof.

An integral flap 48 of substantially the same dimensions as the front walls 8, 26 of the outer shell 2 and inner slide 4 is hingedly connected to the rear wall 28 of the box portion 20 of the inner slide 4 via an intervening panel 50, which is hingedly connected to the lower edge of the rear wall 28. The intervening panel 50 overlies the bottom wall 34 of the box portion 20 of the inner slide 4 and extends from the lower edge of the rear wall 28 of the box portion 20 to proximate the lower edge of the front wall 26 thereof, between the bottom wall 34 of the box portion 20 of the inner slide 4 and the bottom wall 16 of the outer shell 2.

The integral flap 48, which is hingedly connected to the intervening panel 50 along a transverse hinge line 52, extends upwardly between the front wall 26 of the box portion 20 of the inner slide 4 and the front wall 8 of the outer shell 2 from proximate the lower edge of the front wall 26 of the box portion 20 of the inner slide to the transverse slit 18 provided in the front wall 8 of the outer shell 2. The flap 50 then passes through the slit 18 so that when the inner slide 4 is in the closed position shown in FIG. 1 it overlies the front wall 8 of the outer shell 2 above the slit 18.

FIG. 1 shows the container with the inner slide 4 in a closed position in which the open front face of the lid portion 22 (shown in FIG. 2) of the inner slide 4 and the hinge line 24 along which the box 20 and lid 22 portions of the inner slide 4 are connected are covered by the front 8 and rear 10 walls, respectively, of the outer shell 2, such that the bundle of cigarettes 6 (shown in FIG. 2) housed in the inner slide 4 is inaccessible.

In the closed position, the inner slide 4 is contained within the outer shell 2 with rear wall 10, left side wall 12 and right side wall 14 of the outer shell 2 adjacent to and overlying the rear walls 28, 36 (shown in FIG. 4) of the box 20 and lid 22 portions, left side walls 30, 40 of the box 20 and lid 22 portions, and right side walls 32, 42 of the box 20 and lid 22 portions, respectively, of the inner slide 4, and the bottom wall 16 of the outer shell 2 adjacent to and overlying the intervening panel 50. As shown in FIG. 1, the outer shell 2 and the inner slide 4 are of substantially equal height, so that the inner slide 4 does not project outwardly from the outer shell 2 through the open upper end face thereof in the closed position and the top wall 44 of the lid portion 22 of the inner slide 4 forms the top wall of the container.

FIG. 2 shows the container with the inner slide 4 in an open position in which the bottom wall 34 of the inner slide 6 and the intervening panel 50 are spaced apart from the bottom wall 16 of the outer shell 2, and the lid portion 22 and an upper portion of the box portion 20 of the inner slide 2 protrude from the outer shell 2 through the open upper end face thereof. When the inner slide 4 is in this open position, the bundle of cigarettes 6 housed in the inner slide 4 is accessible through the exposed open front face of the lid portion 22 thereof. As shown in FIG. 2, to facilitate access to the bundle of cigarettes 6, the lid portion 22 of the inner slide 4 may be pivoted backwards about the hinge line 24 along which it is connected to the box portion 20 thereof. The central cut-out 36 provided along the free transverse upper edge of the front wall 26 of the box portion 20 of the inner slide 4 also facilitates removal of cigarettes housed in the inner slide 4 from the container when the inner slide is in the open position.

The transverse external cross-section of the inner slide 4 is substantially equal to the transverse internal cross-section of the outer shell 2 so that during opening and closing of the container, frictional forces generated between the outer surface of the inner slide 4 and the inner surface of the outer shell 2 prevent slidable movement of the inner slide 4 within the outer shell 2 until a positive force is applied thereto by the consumer.

In use, to slide the inner slide 4 within the outer shell 2 from the closed position shown in FIG. 1 to the open position shown in FIG. 2, the consumer holds the outer shell 2 of the container in one hand, grasps the pull tab 46 connected to the rear wall 38 of the lid portion 22 of the inner slide 4 with their other hand and pulls the inner slide 4 upwardly through the open upper end face of the outer shell 2 in the direction shown by the block arrow in FIG. 1. As described in more detail below, the container further includes retention means for preventing slidable movement of the inner slide 4 relative within the outer shell 2 beyond the open position shown in FIG. 2.

As well as or instead of the pull tab 46, a pair of opposed cut-outs (not shown) may be provided along the free transverse upper edges of the left 12 and right 14 side walls of the outer shell through which a consumer may grasp the left 30 and right 32 side walls of the inner slide 4 in order to move it from the closed position to the open position. Alternatively or in addition, an opening (not shown) may be provided in the bottom wall 16 of the outer shell 2 through which, in use, a consumer may push on the intervening panel 50 and bottom wall 34 of the inner slide 4 in order to open the container.

The transverse hinge line 52 along which the integral hinged flap 48 is connected to the intervening panel 50 is below the transverse slit 18 in the front wall 8 of the outer shell 2 when the inner slide 4 is in the closed position, and, as described above, the integral hinged flap 48 is in a first position parallel to the front wall 8 of the outer shell 2 and the front wall 26 of the box portion 20 of the inner slide 4. Upward slidable movement of the inner slide 4 within the outer shell 2 from the closed position to the open position moves the hinge line 52 along which the flap 48 is connected to the intervening panel 50 upwardly relative to the transverse slit 18, so that in the second position it is above the transverse slit 18. This causes the flap 48 to pivot about the hinge line 52 to a second position in which it is hinged outwardly from the first wall 8 of the outer shell 2 and the front wall 26 of the box portion 20 of the inner slide 4, as shown in FIG. 2. The inner surface of the flap 48, which faces towards the inner slide 4 when the inner slide 4 is in the closed position and the flap 48 is in the first position, and the upper portion of the front wall 8 of the outer shell 2 above the transverse slit 18, which is covered by the flap 48 when the inner slide 4 is in the closed position and the flap 48 is in the first position, are thus exposed when the inner slide is in the open position and the flap 48 is in the second position. Consequently, graphics or text provided on the inner surface of the flap and the outer surface of the upper portion of the front wall 8 of the outer shell 2 above the transverse slit 18 become visible to the consumer when the container is opened.

The lower portion of the front wall 8 of the outer shell 2 below the transverse slit 18 biases the upper portion of the integral hinged flap 48 that protrudes through the transverse slit towards the front wall 8 of the outer shell 2 when the inner slide 4 is in the closed position. This advantageously ensures that the upper portion of the flap 48 that protrudes through the slit 18 rests against the upper portion of the front wall 8 of the outer shell 2 above the slit 18 in the first position.

Figure 4:
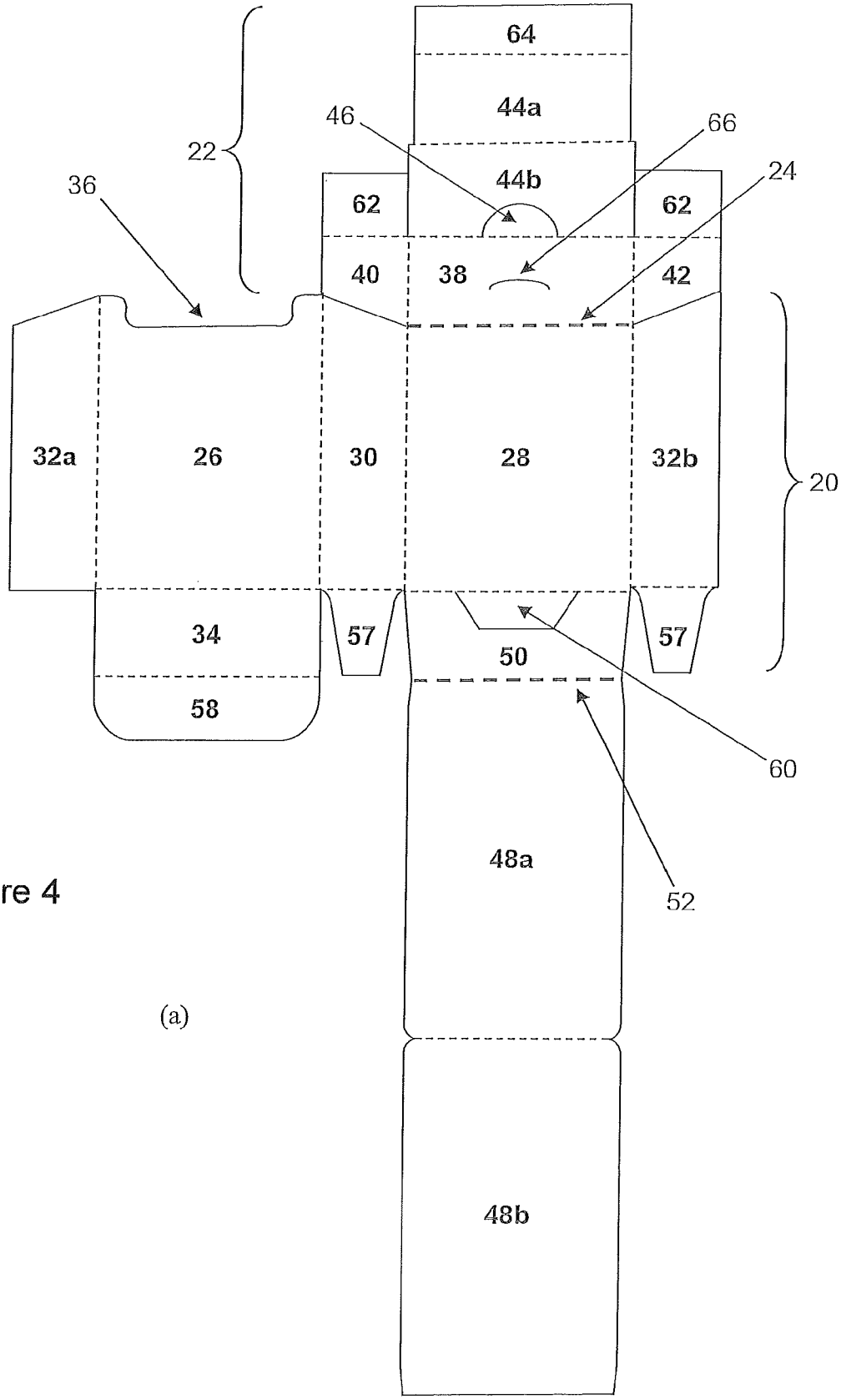
FIG. 4 shows a plan view of a laminar cardboard blank for forming the inner slide of the container of FIG. 1 and FIG. 2.

A one-piece laminar cardboard blank from which the outer shell 2 of the container FIG. 1 and FIG. 2 may be formed is shown in FIG. 3. A one-piece laminar cardboard blank from which the inner slide 4 and hinged flap 48 of the container of FIG. 1 and FIG. 2 may be formed is shown in FIG. 4. Corresponding reference numerals are used in FIG. 3 and FIG. 4 for elements of the blanks that are similar or related to elements of the outer shell 2, inner slide 4 and flap 48 of the container of FIG. 1 and FIG. 2 previously described above. The blanks includes various panels, flaps and tabs (labelled in bold), which when folded about appropriate score lines (shown by broken lines) and affixed with adhesive (not shown) in a conventional manner, form the outer shell 2, inner slide 4 and flap 48 of the container. Throughout the specification, the term score line is used to indicate a line formed by, for example, creasing, scoring, perforating, embossing or otherwise compressing, cutting or weakening the blank.

The blank shown in FIG. 3 for forming the outer shell 2 of the container shown in FIG. 1 and FIG. 2 has a front wall panel 8, a rear wall panel 10, a left side wall panel 12, an inner right side wall panel 14*a*, an outer right side wall panel 14*b*, an inner bottom wall panel 16*a* and an outer bottom wall panel 16*b*, which when the blank is folded form the corresponding walls of the outer shell 2. The blank further includes a pair of lower side wall closure tabs 54, which are connected to the lower edges of the left side wall panel 12 and the outer right side wall panel 14*b* along transverse score lines. The blank also includes an upper retention flap 56, which is connected to the upper edge of the rear wall panel 10 along a transverse score line. As shown in FIG. 3, a transverse slit 18 provided in the front wall panel 8 of the blank extends across the front wall panel 10 between the left side wall panel 12 and the outer right side wall panel 14*b*. To form the outer shell 2, the front 8, rear 10, left side 12, inner right side 14*a* and outer right side 14*b* wall panels are initially folded to form an open ended hollow sleeve and the outer right side wall panel 14*b* affixed to the inner right side wall panel 14*a*. This may advantageously be done by a supplier prior to delivery of the blank to a consumer goods manufacturer. In the next stage, the inner bottom wall panel 16*a*, outer bottom wall panel 16*b* and lower side wall closure tabs 54 are folded through 90 degrees and affixed to one another in a known manner to close the lower end of the hollow sleeve and so form the bottom wall 16 of the outer shell 2. In the final stage, the upper retention flap 56 is folded through 180 degrees so that it rests against the inner surface of the rear wall panel 10 in the formed outer shell 2.

The blank shown in FIG. 4 for forming the inner slide 4 and the integral hinged flap 48 of the container shown in FIG. 1 and FIG. 2 has a box portion front wall panel 26, a box portion rear wall panel 28, a box portion left side wall panel 30, a box portion inner right side wall panel 32*a*, a box portion outer right side wall panel 32*b* and a box portion bottom wall panel 34, which when the blank is folded form the corresponding walls of the box portion 20 of the inner slide 4. A pair of lower box portion side wall closure tabs 57 are connected to the lower edges of the box portion left side wall panel 30 and the box portion outer right side wall panel 32*b* 34 along transverse score lines. A box portion bottom wall closure tab 58 is connected to the box portion bottom wall panel 34 along transverse a score line.

An inner flap panel 48*a* and an outer flap panel 48*b* are connected to the box portion rear wall panel 28 of the blank via an intervening panel 50, which is connected to the lower edge thereof along a transverse score line. As shown in FIG. 4, a trapezoidal lower retention flap 60 cut out from the intervening panel 50 extends from the lower edge of the box portion rear wall panel 28 along the transverse score line.

The blank further includes a lid portion rear wall panel 38, which is connected to the box portion rear wall panel 28 along a transverse hinge line 24 (shown in bold in FIG. 4), a lid portion left side wall panel 40, a lid portion right side wall panel 42, a lid portion outer top wall panel 44*b* and a lid portion inner top wall panel 44*a*. A pair of upper lid portion side wall closure tabs 62 are connected to the upper edges of the lid portion left 40 and right 42 side wall panels along transverse score lines, and a lid portion flap 64 is connected to the lid portion inner top wall panel 44*a* along a transverse a score line. As shown in FIG. 4, a central, semi-circular, pull tab 46, cut out from the lid portion outer top wall panel 44*b*, extends from the upper edge of the lid portion rear wall panel 38.

To form the inner slide 4, the box portion front 26, rear 28, left side 30, inner right side 32*a* and outer right side 32*b* wall panels are initially folded to form an open ended hollow sleeve and the box portion outer right side wall panel 32*b* affixed to the box portion inner right side wall panel 32*a*. In addition, to form the hinged flap 48, the outer flap panel 48*b* is folded through 180 degrees and permanently or releasably affixed to the inner flap panel 48*a*. This may advantageously be done by a supplier prior to delivery of the blank to a consumer goods manufacturer. Forming the integral hinged flap 48 by permanently affixing the two overlying foldably connected sub-panels (i.e. the outer flap panel 48*b* and the inner flap panel 48*a*) to one another advantageously enables the inner and outer surfaces of the hinged flap 48 to be provided with consumer information by printing one side of the blank. If the integral hinged flap 48 were formed from a single panel, it would be necessary to print both sides of the blank shown in FIG. 4 in order to provide consumer information on the inner and outer surfaces of the hinged flap 48.

To complete erection of the body portion 20 of the inner slide 4, the box portion bottom wall panel 34, box portion lower side wall closure tabs 57 and box portion bottom wall closure tab 58 are folded through 90 degrees and affixed in a known manner to close the lower end of the hollow sleeve and so form the bottom wall 34 of the body portion 20 of the inner slide 4. The intervening panel 50 is folded through 90 degrees so that it overlies the box portion bottom wall panel 34 and the upper retention flap 56 is folded outwardly through 180 degrees so that it rests against the outer surface of the box portion rear wall panel 28. The trapezoidal lower retention flap 60 is also folded 180 degrees so that it rests against the outer surface of the box portion rear wall panel 28.

To erect the lid portion 22 of the inner slide 2, the lid portion outer top wall panel 44*b*, the lid portion left 40 and right 42 side wall panels and the upper lid portion side wall closure tabs 62 are folded through 90 degrees and the upper lid portion side wall closure tabs 62 affixed to the inner surface of the lid portion outer top wall panel 44*b*. To complete erection of the lid portion 22, the lid portion inner top wall panel 44*a* is folded inwardly through 180 degrees, so that it rests against the inner surface of the lid portion outer top wall panel 44*b*, and the lid portion flap 64 is folded through 90 degrees, so that it rests against the lid portion rear wall panel 38. To retain the lid portion flap 64 in position, the lower edge thereof is inserted in a narrow curved slit 66 provided in the lid portion rear wall panel 38.

It will be appreciated that the precise order in which the various panels, flaps and tabs of the one-piece laminar cardboard blanks shown in FIG. 3 and FIG. 4 are folded and secured to one another to form the outer shell 2, inner slide 4 and flap 48 of the container of FIG. 1 and FIG. 2 may be varied depending upon, for example, the apparatus used to produce the container.

During erection of the of the container shown in FIG. 1 and FIG. 2 from the blanks shown in FIG. 3 and FIG. 4, the inner slide 4 is inserted into the outer shell 2 through the open upper end face thereof and the hinged flap 48 connected to the inner slide 4 is inserted through the transverse slit 18 provided in the front wall 8 of the outer shell 2 and inner slide 4. In use, as the inner slide 4 reaches the open position shown in FIG. 2, the upper retention flap 56 of the outer shell 2 engages the lower retention flap 60 of the inner slide 4, thereby advantageously preventing further upward slidable movement of the inner slide 2 within the outer shell 4 beyond the open position. The interaction between the upper retention flap 56 of the outer shell 2 and the retention flap 60 of the inner slide 4 also advantageously prevents removal of the inner slide 4 of the container from the outer shell 4 thereof.

In the container shown in FIG. 1 and FIG. 2, the integral hinged flap 48 is of substantially the same dimensions as the front wall of the outer shell 2. However, it will be appreciated that containers may have hinged flaps of reduced dimensions compared to the first wall of the outer shell in which the aperture is provided.

The invention has been exemplified above with reference to a container including an outer shell formed from a first one-piece laminar blank and an inner slide and integral flap formed from a second one-piece laminar blank. However, containers may include an inner slide and a non-integral flap that is adhered or otherwise affixed to the inner slide. For example, containers may include an outer shell formed from a first one-piece laminar blank, an inner slide formed from a second one-piece laminar blank and a flap formed from a third one-piece laminar blank.

Containers may also include inner slides in which the lid portion of the inner slide is omitted. For example, the inner slide may be a tray or box with an open face or with an opening provided in a wall thereof, wherein the open face or opening is covered by the outer shell when the inner slide is in the closed position and at least partially exposed when the inner slide is in the open position such that consumer goods housed in the inner slide are accessible there through.

In the embodiment described above, the outer shell of the container includes a bottom wall. However, it will be appreciated that this is not an essential feature and containers may include outer shells in which the bottom wall is omitted (i.e. outer shells with opposed open faces). It will also be appreciated that while in the embodiment described, the inner slide has a lid portion with an open front face, containers may include inner slides with a lid portion having a front wall, a rear wall, opposed side walls and a top wall.

Furthermore, it will be appreciated that, while in the embodiment described above the aperture is provided in the front wall of the outer shell, an aperture may alternatively be provided in the rear wall, or one of the side walls of the outer shell. Similarly, it will be appreciated that while in the embodiment described above the flap is connected to the rear wall of the inner slide, depending upon the wall of the outer shell in which the aperture is provided, the flap may alternatively be connected to one of the other walls of the inner slide.

In addition, it will be appreciated that containers may include an outer shell having two or more walls with apertures provided therein and two or more flaps connected to the inner slide thereof, each of which protrudes through a separate one of the apertures and is pivotable between a first position and a second position upon slidable movement of the inner slide between the closed and open positions.

In this specification, the word "about" is often used in connection with numerical values to indicate that mathematical precision of such values is not intended. Accordingly, it is intended that where "about" is used with a numerical value, a tolerance of ±10% is contemplated for that numerical value.

In this specification the words "generally" and "substantially" are sometimes used with respect to terms. When used with geometric terms, the words "generally" and "substantially" are intended to encompass not only features which meet the strict definitions but also features which fairly approximate the strict definitions. In this connection, the term "rounded" is intended to also include configurations including two or more substantially straight line segments describing the "rounded" feature.

While the foregoing describes in detail a preferred a slide and shell container with hinged flap and methods of making the container with reference to a specific embodiment thereof, it will be apparent to one skilled in the art that various changes and modifications may be made to the container and equivalent methods may be employed, which do not materially depart from the spirit and scope of the foregoing description. Accordingly, all such changes, modifications, and equivalents that fall within the spirit and scope of the appended claims are intended to be encompassed thereby.

I claim:

1. A slide and shell container comprising:

an outer shell having a first wall with an aperture provided therein and an outer shell bottom;

an inner slide having an inner slide bottom and being slidable within the outer shell between a closed position in which the interior of the inner slide is inaccessible and an open position in which the interior of the inner slide is accessible, the inner slide bottom resting against the outer shell bottom in the closed position; and a hinged flap free of connection to the outer shell, but connected to the inner slide and protruding through the aperture in the first wall of the outer shell at the closed position, the open position, and positions intermediate the open and closed positions, wherein the hinged flap is pivotable between a first position in the closed position in which the flap rests against the outside of the first wall of the outer shell and a second position in which the flap is hinged outwardly from the first wall of the outer shell upon slidable movement of the inner slide between the closed and open positions.

2. The container of claim 1, wherein the inner slide includes a box portion and a lid portion connected to the box portion along a hinge about which the lid portion is pivotable when the inner slide is in the open position.

3. The container of claim 1, wherein the hinged flap is connected to the box portion of the inner slide.

4. The container of claim 1, wherein the hinge flap is of substantially the same dimensions as the first wall of the outer shell.

5. The container of claim 1, wherein the hinge flap partially covers the outer surface of the first wall of the outer shell in the first position.

6. The container of claim 1, wherein the hinge flap is integral with the inner slide.

7. The container of claim 1, further including retention means for preventing removal of the inner slide from the outer shell.

8. The container of claim 1, further including a pull tab connected to the inner slide, which, in use, may be grasped and pulled on by a consumer in order to slide the inner slide within the outer shell from the closed position to the open position.

9. The container of claim 1, wherein the hinged flap comprises two or more integral, foldably connected, overlying sub-panels.

10. The container of claim 1, wherein the inner slide houses a plurality of smoking articles.

* * * * *